US006712483B2

(12) United States Patent
Lin et al.

(10) Patent No.: US 6,712,483 B2
(45) Date of Patent: Mar. 30, 2004

(54) DECORATIVE LIGHT DEVICE HAVING ROTARY ACTUATING MEMBER

(75) Inventors: Chun Liang Lin, Chong Ho (TW); Chun Chu Lin, Chong Ho (TW)

(73) Assignee: Hung Liang Co., Taipei (TW)

( * ) Notice: Subject to any disclaimer, the term of this patent is extended or adjusted under 35 U.S.C. 154(b) by 0 days.

(21) Appl. No.: 10/189,983

(22) Filed: Jul. 2, 2002

(65) Prior Publication Data

US 2004/0004832 A1 Jan. 8, 2004

(51) Int. Cl.[7] ..... F21V 33/00
(52) U.S. Cl. ..... 362/101; 362/206; 362/208
(58) Field of Search ..... 362/101, 109, 362/202, 203, 205, 206, 208; 200/60

(56) References Cited

U.S. PATENT DOCUMENTS 4,858,083 A * 8/1989 Wakimoto ..... 362/208
5,008,784 A * 4/1991 Wang ..... 362/206
6,024,467 A * 2/2000 Liu ..... 362/205

* cited by examiner

*Primary Examiner*—Y My Quach Lee

(57) ABSTRACT

A light device includes a light member coupled to a circuit board, a stationary conductor engaged in a bucket and coupled to the circuit board, a movable conductor disposed close to the bucket and received in a follower which is coupled to the circuit board and which may rotate the movable conductor to contact with the stationary conductor or to be supported on the peripheral wall of the bucket and to be disengaged from the stationary conductor. The conductors may each include two ends heads for engaging with each other or for separating the conductors from each other.

15 Claims, 7 Drawing Sheets

DECORATIVE LIGHT DEVICE HAVING ROTARY ACTUATING MEMBER

BACKGROUND OF THE INVENTION

1. Field of the Invention

The present invention relates to an illuminative device or a light device, and more particularly to a decorative light device having a rotary actuating member.

2. Description of the Prior Art

Various kinds of typical light devices have been developed for generating lights, warning lights, etc., and comprise one or more batteries coupled to one or more light bulbs or the like, and a switch disposed or coupled between the batteries and the light bulbs, or coupled in the electric circuit to the light bulbs, for controlling the energizing of the light bulbs. The switches normally include a switch button to be depressed or actuated by the users in order to control the on and off of the light bulbs.

However, the switch button may be depressed inadvertently, such that the light bulbs may be energized inadvertently, and such that the batteries may be consumed inadvertently.

Some of the typical light devices may include a control ferrule rotatably attached to a light housing, and movable relative to the light housing, for adjusting the light beam of the light devices. However, the rotational movement of the control ferrule relative to the light housing may not be used for controlling the on and off of the light bulbs.

The present invention has arisen to mitigate and/or obviate the afore-described disadvantages of the conventional light devices.

SUMMARY OF THE INVENTION

The primary objective of the present invention is to provide a decorative light device including a rotary actuating member for effectively actuating and controlling the light device.

The other objective of the present invention is to provide a decorative light device including two conductors that may be selectively contacted with each other to control the light device.

In accordance with one aspect of the invention, there is provided a light device comprising a circuit board, a light member coupled to the circuit board, means for energizing the light member, a bucket including a bore formed therein and defined in a peripheral wall, and including a first end, a first conductor engaged in the first end of the bucket, and electrically coupled to the circuit board, a second conductor disposed close to the first end of the bucket, a follower electrically coupled to the circuit board, and rotatably disposed close to the first end of the bucket and engaged onto the second conductor, for rotating the second conductor to align with and to contact with the first conductor, and for rotating the second conductor to be supported on the peripheral wall of the bucket and to be disengaged from the first conductor. The second conductor is selectively caused to be engaged with and electrically contacted with the first conductor when the second conductor is rotated relative to the bucket by the follower.

The first conductor includes two ends each having an enlarged head provided thereon. The second conductor includes two ends each having an enlarged head provided thereon, for selectively engaging with the heads of the first conductor when the second conductor is rotated to be aligned with the first conductor.

The first end of the bucket includes a pair of depressions formed in the peripheral wall thereof for receiving the heads of the second conductor. The first end of the bucket includes a pair of apertures formed in the peripheral wall thereof for receiving the heads of the first conductor.

The follower includes a lateral channel formed therein for receiving the second conductor, and for rotating the second conductor relative to the bucket.

A casing is further provided and has a space formed therein for rotatably receiving the follower, the bucket is received in the space of the casing. The follower includes a first end extended outward of the casing, and a knob secured to the first end of the follower for rotating the follower relative to the casing.

The follower includes a cavity formed therein, a spring received in the cavity of the follower, and engaged with the second conductor for biasing the second conductor to engage with the first conductor.

The energizing means includes a battery partially received in the bore of the bucket and having a first electrode electrically coupled to the first conductor and having a second electrode coupled to the circuit board.

The circuit board includes a socket attached thereto and having a socket opening formed therein for receiving the second electrode of the battery.

A housing is further provided for partially receiving the battery, the socket and the circuit board are received in the housing, and a decorative member is attached to the housing.

A barrel is further provided and attached to the housing, the decorative member is attached to the barrel and includes a cavity formed therein for receiving the light member.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
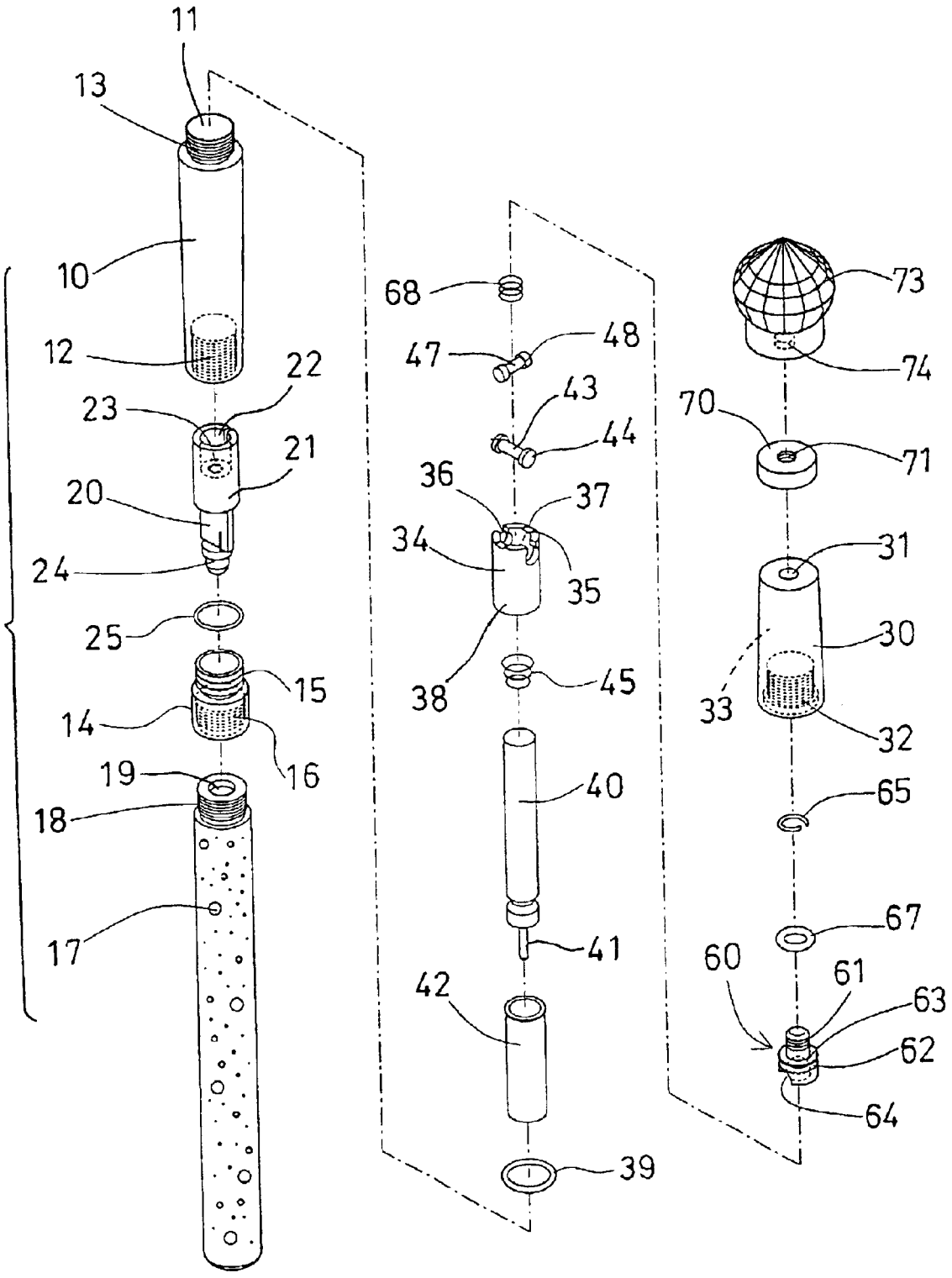
FIG. 1 is an exploded view of a light device in accordance with the present invention.
Figure 3:
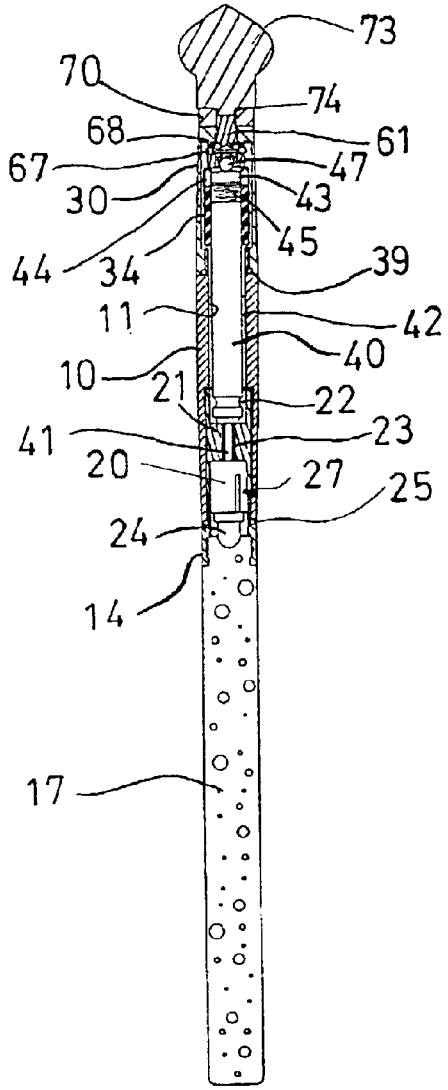
FIG. 3 is a partial cross sectional view taken along lines 3—3 of FIG. 2.
Figure 2:
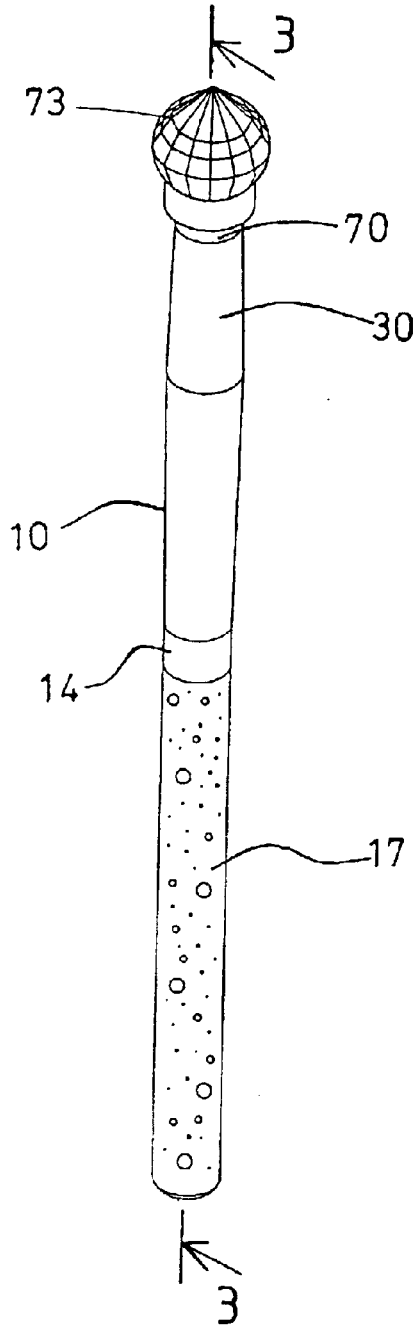
FIG. 2 is a perspective view of the decorative light device.

Referring to the drawings, and initially to FIGS. 1–3, a decorative light device in accordance with the present invention comprises a housing 10 including a chamber 11 formed therein, and including an inner thread 12 formed in the lower portion thereof, and including an outer thread 13 formed in the upper portion thereof.

A barrel 14 includes an outer thread 15 formed on one end for threading with the inner thread 12 of the housing 10, and for securing the barrel 14 to the housing 10; and includes an inner thread 16 formed in the other end thereof for threading with an outer thread 18 of a decorative member 17 which includes a cavity 19 formed in one end thereof and located within the barrel 14.

A circuit board 20 is received in the housing 10, and includes a socket 21 attached thereto and having a socket opening 22 and an orifice 23 formed therein. A light member 24, such as a light bulb, a light emitting diode, or the like is attached to the circuit board 20, and partially engaged in the cavity 19 of the decorative member 17.

It is preferable that the decorative member 17 is made of transparent or semi-transparent materials, for allowing the light generated by the light member 24 to be transmitted through the decorative member 17 and to be seen through the decorative member 17. The decorative member 17 may be made or formed into various kinds of shapes or profiles for decorative purposes.

The socket 21 is made of non-conductive materials. A sealing ring 25 is preferably provided and engaged between the housing 10 and the barrel 14 for making a water tight seal between the housing 10 and the barrel 14, and for preventing water or humidity from entering into the barrel 14 and the housing 10 to damage the circuit board 20 and the light member 24.

The circuit board 20 may include a conductor or a terminal 27 provided thereon or extended therefrom (FIG. 3) for electrically coupling to or engaging with the housing 10 which is made of electric conductive materials. The terminal 27 and the housing 10 may be electrically coupled to either the case electrode or the central electrode of the light member 24.

A conductive casing 30 includes a hole 31 formed in one end thereof and communicating with the hollow space 33 thereof, and includes an inner thread 32 formed in the other end thereof for threading with the outer thread 13 of the housing 10, and for securing the casing 30 to the housing 10, and for electrically coupling the casing 30 to the housing 10. The casing 30 may also be formed as a one-piece integral member with the housing 10.

A non-conductive bucket 34 is received in the space 33 of the casing 30, and includes a bore 35 formed therein, and includes an aperture 36 or a pair of apertures 36 formed in one end of the peripheral wall 38 of the bucket 34, and includes a depression 37 or a pair of depressions 37 formed in the peripheral wall 38 of the bucket 34, and offset from the apertures 36 of the bucket 34.

One or more batteries 40 may be partially received in the bucket 34 and the housing 10, and include a first electrode, such as a central electrode 41 engaged into the socket opening 22 and the orifice 23 of the socket 21, and electrically coupled to either the central electrode or the case electrode of the light member 24.

A protective and non-conductive sleeve 42 may be disposed between the batteries 40 and the housing 10 for safety purposes, or for preventing the batteries 40 from electrically contacting with the housing 10. A sealing ring 39 is preferably engaged between the housing 10 and the casing 30 for making a water tight seal and for preventing water or humidity from damaging the batteries 40.

A conductor member 43 is engaged in the aperture 36 of the bucket 34, or includes a pair of enlarged heads 44 provided on the ends thereof and engaged in the apertures 36 of the peripheral wall 38 of the bucket 34 respectively. A spring 45 is received in the bucket 34 and selectively or optionally or electrically coupled between the conductor 43 and the case electrode of the batteries 40.

Another conductor member 47 is provided above the bucket 34, and includes two ends or two enlarged end heads 48 for being selectively received in the depressions 37 of the peripheral wall 38 of the bucket 34 respectively, or for selectively and electrically contacting with the conductor member 43 when the conductor member 47 is rotated relative to the other conductor member 43.

A follower 60 is rotatably received in the casing 30, and includes an extension 61 extended through the hole 31 of the casing 30, and a peripheral recess 62 formed in the outer peripheral portion thereof for receiving a sealing ring 67 therein and for making a water tight seal with the casing 30. A clamping ring 65 may be engaged into the extension 61 and engaged with the casing 30 for rotatably securing the follower 60 to the casing 30, for example.

The follower 60 includes a cavity 63 formed therein, such as formed in the bottom portion thereof for receiving a spring 68 therein, and includes a lateral channel 64 formed therein, such as formed in the bottom portion thereof and communicating with the cavity 63 thereof, for receiving and thus for rotating the conductor member 47 relative to the other conductor member 43.

Figure 8:
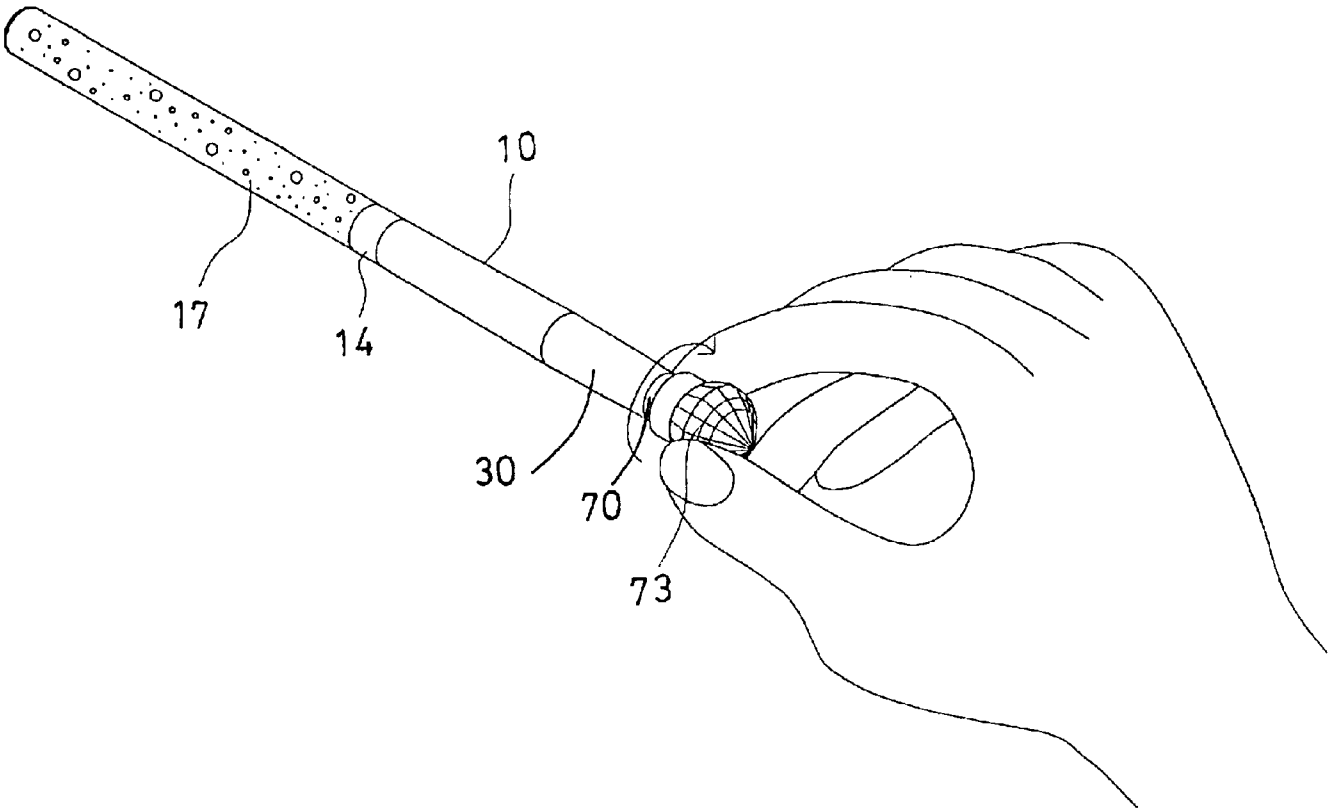
FIGS. 8, 9, 10 are perspective views illustrating the operation and/or the application of the light device.
Figure 9:
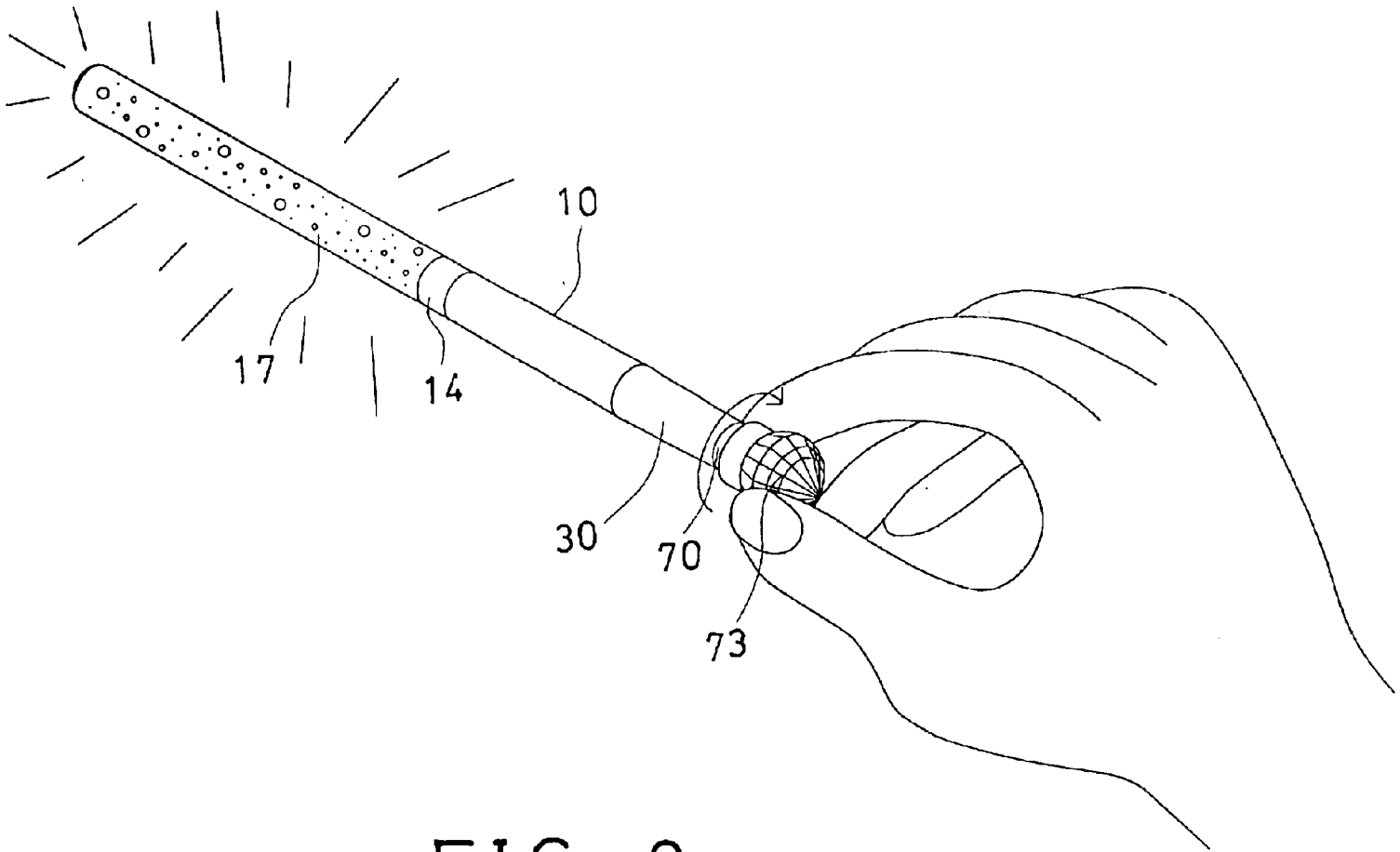

The extension 61 of the follower 60 may be threaded to a screw hole 71 of a seat 70, and a knob 73 may include a screw or a fastener 74 extended therefrom and threaded to the screw hole 71 of the seat 70, for securing the knob 73 to the follower 60 and for allowing the follower 60 to be rotated relative to the casing 30 and the housing 10 with the knob 73 (FIGS. 8, 9).

Figure 10:
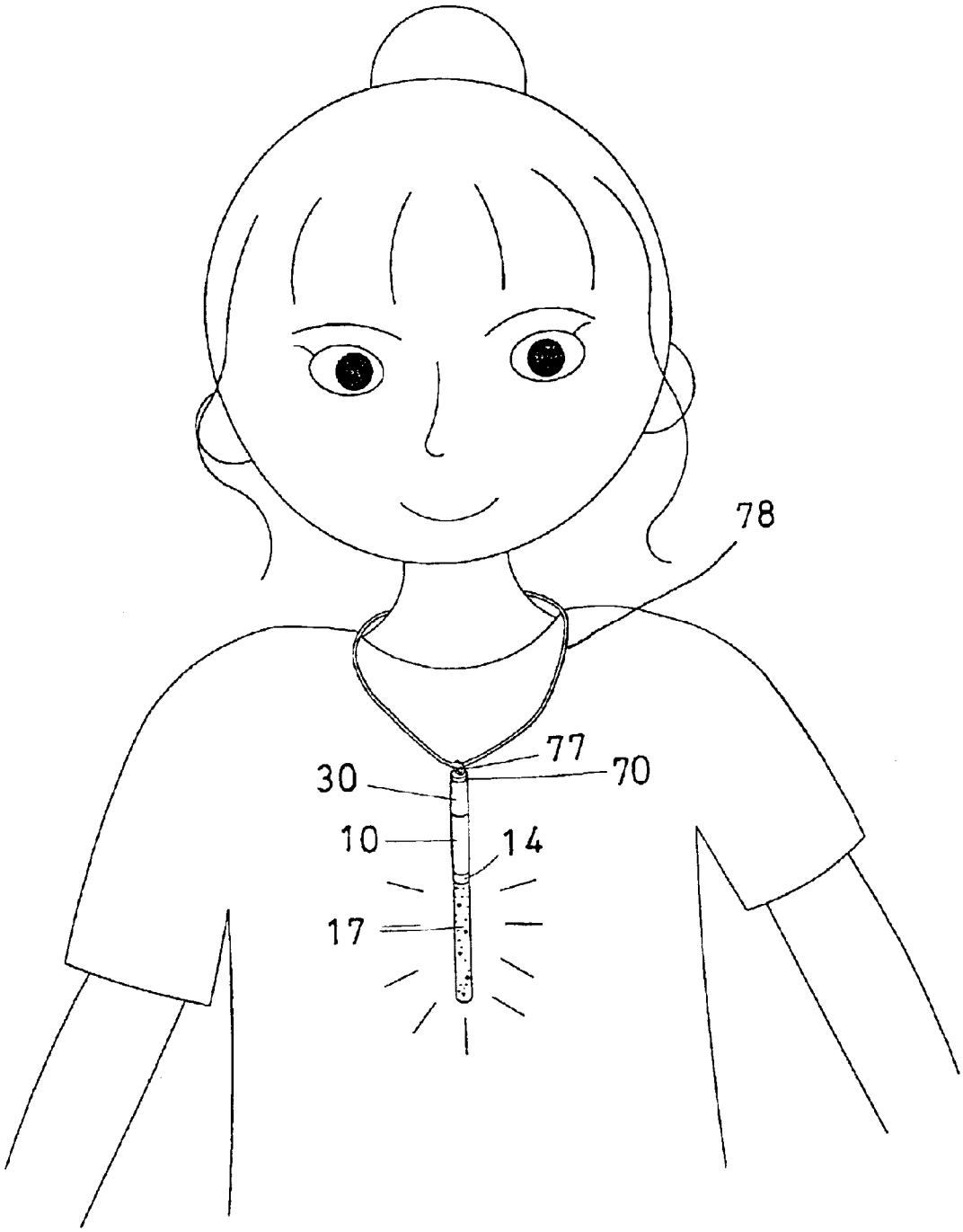

The knob 73 may also be directly secured to the follower 60 without the seat 70. Alternatively, as shown in FIG. 10, a loop, or a ring 77 or the like may be attached to the seat 70 or to the follower 60 for rotating the follower 60 relative to the casing 30 and the housing 10, and for coupling the light device to a chain 78 or the like.

Figure 4:
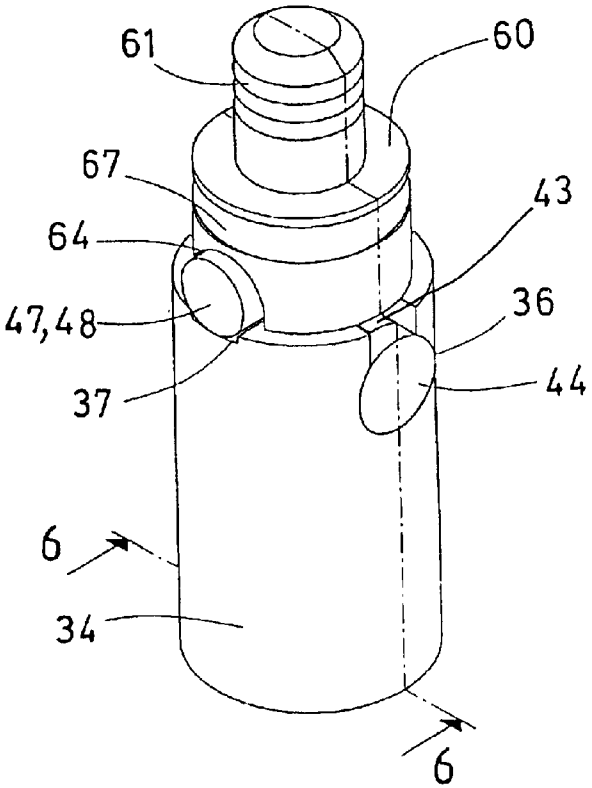
Figure 6:
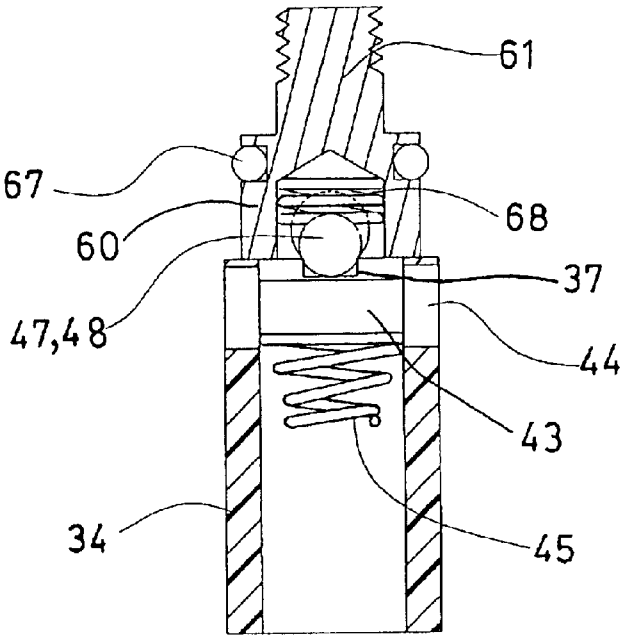
FIGS. 6, 7 are partial cross sectional views taken along lines 6—6, and 7—7 of FIGS. 4 and 5 respectively.

In operation, as shown in FIGS. 4 and 6, when the conductor 47 is rotated by the knob 73 and selectively received in the depression(s) 37 of the peripheral wall 38 of the bucket 34, or perpendicular to or offset from the conductor 43, the conductor 47 or the heads 48 may be disengaged from the conductor 43 or the heads 44, such that the electric circuit to the light member 24 may be turned off or shut off.

Figure 5:
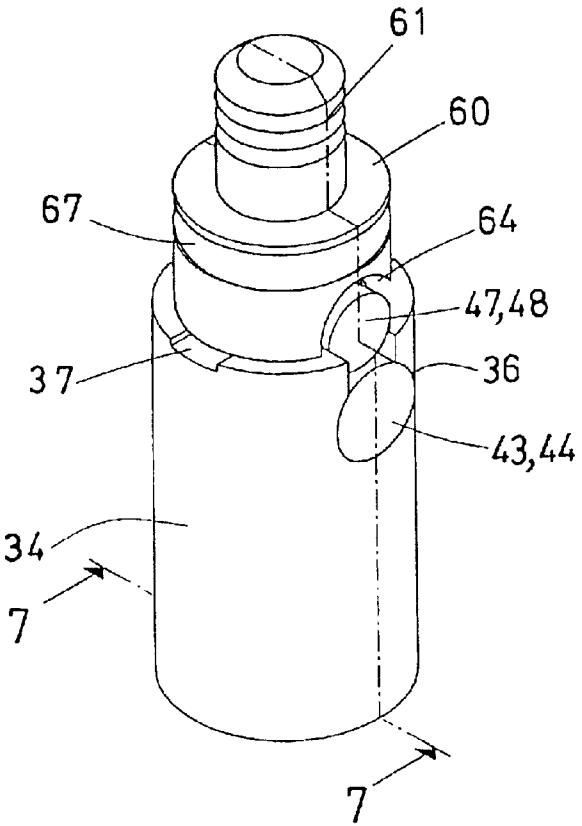
FIGS. 4, 5 are perspective views illustrating the operation or the actuation between two conductors of the light device.
Figure 7:
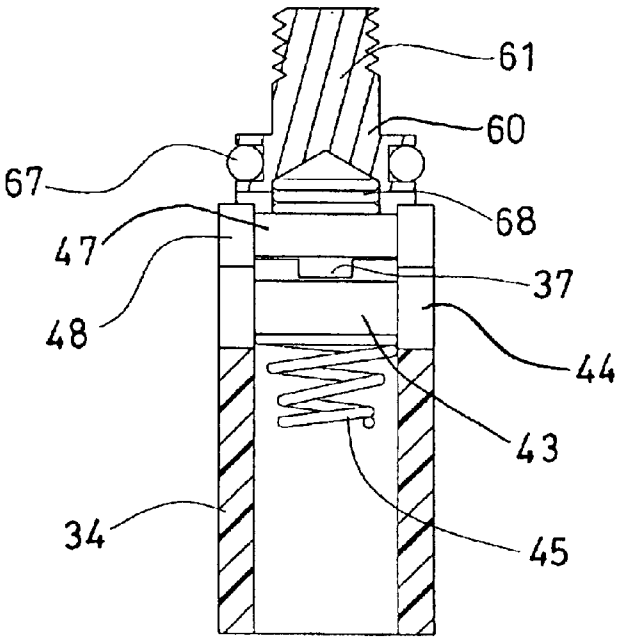

As shown in FIGS. 5 and 7, when the conductor 47 is rotated by the knob 73 and aligned with the conductor 43, the conductor 47 or the heads 48 may be engaged with or contacted with the conductor 43 or the heads 44, such that the electric circuit to the light member 24 may be turned on, and such that the light member 24 may be energized by the batteries 40. The spring 68 may further be used to bias and force the conductor 47 or the heads 48 to be contacted with the conductor 43 or the heads 44.

As shown in FIGS. 1 and 3, the case electrode of the batteries 40 may be coupled to the conductor 43 directly or with the spring 45. When the conductor 47 or the heads 48 may be engaged with or contacted with the conductor 43 or the heads 44, the conductor 47 or the heads 48 may be electrically coupled to the follower 60 or via the spring 68.

The follower 60 is then electrically coupled to the casing 30 which is electrically coupled to the housing 10. The housing 10 may be directly coupled to the light member 24 or coupled to the circuit board 20 with the terminal 27 (FIG. 3). The central electrode 41 of the batteries 40 is coupled to the socket 21 of the circuit board 20, such that the light member 24 may be energized by the batteries 40 when the conductor 47 or the heads 48 are contacted with the conductor 43 or the heads 44.

It is to be noted that the conductors 43, 47 may be made with or without the heads 44, 48. The formation or the provision of the heads 44, 48 on the ends of the conductors

43, 47 is to make sure that the heads 44, 48 of the conductors 43, 47 may be effectively and electrically coupled with each other (FIGS. 5, 7), and to make sure that the conductors 43, 47 may be absolutely disengaged or separated from each other (FIGS. 4, 6).

It is further to be noted that the conductor 47 and the heads 48 may be rotated and caused to be disengaged from the other conductor 43 and the heads 44 thereof by the follower 60 or by the knob 73, and the conductor 47 and the heads 48 will have no chance to be engaged with the other conductor 43 and the heads 44 inadvertently when the conductor 47 or the heads 48 are rested in the depression(s) 37 of the peripheral wall 38 of the bucket 34.

Accordingly, the decorative light device in accordance with the present invention includes a rotary actuating member for effectively actuating and controlling the light device, and includes two conductors that may be selectively contacted with each other to control the light device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A light device comprising:

a circuit board, a light member coupled to said circuit board, means for energizing said light member, a bucket including a bore formed therein and defined in a peripheral wall, and including a first end, a first conductor engaged in said first end of said bucket, and electrically coupled to said circuit board, a second conductor disposed close to said first end of said bucket, a follower electrically coupled to said circuit board, and rotatably disposed close to said first end of said bucket and engaged onto said second conductor, for rotating said second conductor to align with and to contact with said first conductor, and for rotating said second conductor to be supported on said peripheral wall of said bucket and to be disengaged from said first conductor, said second conductor being selectively caused to be engaged with and electrically contacted with said first conductor when said second conductor is rotated relative to said bucket by said follower.

2. The light device according to claim 1, wherein said first conductor includes two ends each having an enlarged head provided thereon.

3. The light device according to claim 2, wherein said second conductor includes two ends each having an enlarged head provided thereon, for selectively engaging with said heads of said first conductor when said second conductor is rotated to be aligned with said first conductor.

4. The light device according to claim 3, wherein said first end of said bucket includes a pair of depressions formed in said peripheral wall thereof for receiving said heads of said second conductor.

5. The light device according to claim 2, wherein said first end of said bucket includes a pair of apertures formed in said peripheral wall thereof for receiving said heads of said first conductor.

6. The light device according to claim 1, wherein said follower includes a lateral channel formed therein for receiving said second conductor, and for rotating said second conductor relative to said bucket.

7. The light device according to claim 1 further comprising a casing having a space formed therein for rotatably receiving said follower, said bucket being received in said space of said casing.

8. The light device according to claim 7, wherein said follower includes a first end extended outward of said casing, and a knob secured to said first end of said follower for rotating said follower relative to said casing.

9. The light device according to claim 1, wherein said follower includes a cavity formed therein, a spring received in said cavity of said follower, and engaged with said second conductor to engage with said first conductor.

10. The light device according to claim 1, wherein said energizing means includes a battery partially received in said bore of said bucket and having a first electrode electrically coupled to said first conductor and having a second electrode coupled to said circuit board.

11. The light device according to claim 10, wherein said circuit board includes a socket attached thereto and having a socket opening formed therein for receiving said second electrode of said battery.

12. The light device according to claim 11 further comprising a housing for partially receiving said battery, said socket and said circuit board being received in said housing, a barrel attached to said housing, and a decorative member attached to said barrel.

13. The light device according to claim 12, wherein said decorative member includes a cavity formed therein for receiving said light member.

14. The light device according to claim 1, wherein said second conductor includes two ends each having an enlarged head provided thereon.

15. The light device according to claim 14, wherein said first conductor includes two ends each having an enlarged head provided thereon, for selectively engaging with said heads of said second conductor when said second conductor is rotated to be aligned with said first conductor.

* * * * *